US008864192B2

(12) United States Patent
Lesueur

(10) Patent No.: US 8,864,192 B2
(45) Date of Patent: Oct. 21, 2014

(54) SAFETY DEVICE FOR VEHICLE HANDLES AND VEHICLE HANDLE COMPRISING THIS SAFETY DEVICE

(75) Inventor: Guillaume Lesueur, Creteil Cedex (FR)

(73) Assignee: VALEO S.p.A., Santena (IT)

( * ) Notice: Subject to any disclaimer, the term of this patent is extended or adjusted under 35 U.S.C. 154(b) by 98 days.

(21) Appl. No.: 13/144,989

(22) PCT Filed: Dec. 22, 2009

(86) PCT No.: PCT/EP2009/067738

§ 371 (c)(1),
(2), (4) Date: Aug. 24, 2011

(87) PCT Pub. No.: WO2010/081618

PCT Pub. Date: Jul. 22, 2010

(65) Prior Publication Data

US 2011/0298228 A1 Dec. 8, 2011

(30) Foreign Application Priority Data

Jan. 19, 2009 (IT) ..... MI2009A0042

(51) Int. Cl.
*E05B 3/00* (2006.01)
*E05B 77/06* (2014.01)
*E05B 65/10* (2006.01)

(52) U.S. Cl.
CPC ..... *E05B 77/06* (2013.01); *Y10S 292/22* (2013.01); *Y10S 292/65* (2013.01)
USPC ..... 292/336.3; 292/92; 292/DIG. 22; 292/DIG. 65

(58) Field of Classification Search
USPC ..... 292/342, DIG. 22, DIG. 65, 92, 93, 240, 292/219, 232, 197, 200, DIG. 73, 1, 336.3, 292/256.63
See application file for complete search history.

(56) References Cited

U.S. PATENT DOCUMENTS

| | | | | |
|---|---|---|---|---|
| 1,434,541 | A * | 11/1922 | Hopf | 292/137 |
| 5,092,642 | A * | 3/1992 | Lindmayer et al. | 292/336.3 |
| 7,070,216 | B2 * | 7/2006 | von zur Muehlen | 292/336.3 |
| 7,481,468 | B2 * | 1/2009 | Merideth et al. | 292/137 |
| 7,686,355 | B2 * | 3/2010 | Jankowski et al. | 292/336.3 |
| 2002/0059693 | A1 * | 5/2002 | Jooss et al. | 16/412 |
| 2006/0261602 | A1 * | 11/2006 | Jankowski et al. | 292/216 |
| 2006/0261603 | A1 * | 11/2006 | Cetnar et al. | 292/216 |
| 2007/0085349 | A1 * | 4/2007 | Merideth et al. | 292/183 |

FOREIGN PATENT DOCUMENTS

| | | | |
|---|---|---|---|
| DE | 198 58 416 | A1 | 6/2000 |
| DE | 10114965 | A1 * | 10/2002 |
| IT | MI2007001748 | A | 11/2007 |
| WO | 2008/068262 | A1 | 6/2008 |
| WO | 2009/034035 | A1 | 3/2009 |

OTHER PUBLICATIONS

International Search Report from PCT/EP2009/067738 dated Mar. 12, 2010 (2 pages).

* cited by examiner

*Primary Examiner* — Kristina Fulton
*Assistant Examiner* — Faria Ahmad
(74) *Attorney, Agent, or Firm* — Osha Liang LLP

(57) ABSTRACT

Safety device comprising an inertial mass (1) pivoted to a frame (2) for rotating around an axis (4), wherein elastic means (6) act on the inertial mass (1) for opposing its rotation, a wedge (12) being arranged in the frame (2) so that the inertial mass (1), when it rotates around this axis (4), slides along the inclined wall of the wedge (12), so as to axially move the inertial mass (1) along this axis (4).

9 Claims, 2 Drawing Sheets

SAFETY DEVICE FOR VEHICLE HANDLES AND VEHICLE HANDLE COMPRISING THIS SAFETY DEVICE

The present invention relates to a safety device for vehicle handles, and in particular to a safety device which can be applied to a door handle of a motor vehicle for preventing the accidental opening of this door in case of accident. The present invention also relates to a vehicle handle comprising this safety device.

Italian patent application MI2007A001748 discloses a safety device comprising an inertial mass pivoted to the frame of a handle, wherein elastic means act on the inertial mass for opposing its rotation in a direction substantially equal to the direction of the lever of said handle when it is pulled outwards for opening the door. Said device comprises a flexible plate which is fixed to the frame and is elastically bent by a tooth of the inertial mass during the normal use of the handle. In case of impact, the inertial mass rotates if it undergoes an acceleration suitable for overcoming the opposition of the elastic means. During this rotation, the tooth falls into an opening made in flexible plate, so as to lock the inertial mass in an impact position in which a stop member protruding from the inertial mass can intercept a protrusion protruding from a rocker mechanically connected to the handle lever, so as to prevent the rotation of this lever after the impact.

Said known device is relatively complex and further it is difficult to be unlocked after an impact or more simply after an accidental activation during the assembling or the carriage of the handle.

It is therefore an object of the present invention to provide a device which is free from said disadvantages. Said object is achieved with a device and a handle whose main features are disclosed in claim 1, while other features are disclosed in the remaining claims.

Thanks to the wedge arranged in the frame, the inertial mass is moved axially during its rotation around its own axis, so as to reach a locking position wherein the inertial mass is locked by the transversal wall of the wedge. With this arrangement, not only the inertial mass can be easily unlocked but also the manufacturing times and costs of the device are decreased, especially if the wedge is made in a single piece with the frame.

According to a particular aspect of the invention, the elastic means acting on the inertial mass for opposing said axial moving are the same elastic means opposing its rotation, preferably a helical spring arranged around the rotation axis of the inertial mass, so as to further reduce the manufacturing costs and increasing the reliability of the device.

Further advantages and features of the device according to the present invention will become clear to those skilled in the art from the following detailed and non-limiting description of an embodiment thereof with reference to the attached drawings, wherein.

Figure 1:
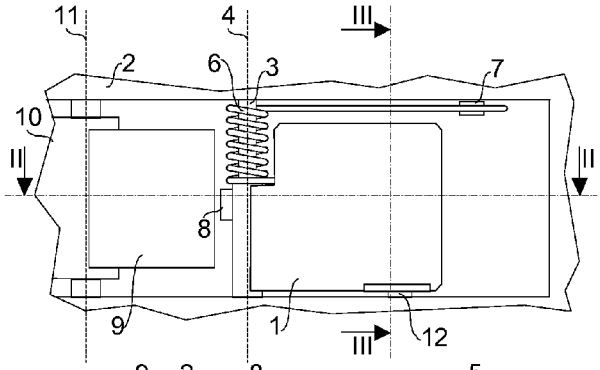
FIG. 1 shows a partial rear view of a handle comprising the device in the rest position.
Figure 2:
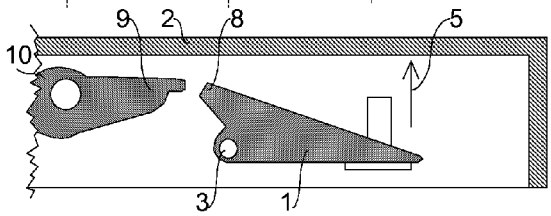
FIG. 2 shows section II-II of FIG. 1.
Figure 3:
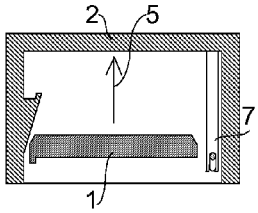
FIG. 3 shows section III-III of FIG. 1.

Referring to FIGS. 1 to 3, it is seen that the device according to the present invention comprises in a known way an inertial mass 1 pivoted to a frame 2 by means of at least one pin 3 for rotating around a first axis 4. Frame 2 is in particular the frame of a handle of a door for vehicles. Elastic means act on inertial mass 1 for opposing its rotation in a first direction 5 which is substantially the same direction of the lever (not shown in the figures) of said handle when it is pulled outwards for opening the door. In particular, said elastic means comprise a helical spring 6 which is arranged around first axis 4 and has an end in contact with a support 7 of frame 2 and the other end in contact with inertial mass 1. A stop member 8 protrudes from inertial mass 1 for intercepting during its rotation around first axis 4 a protrusion 9 protruding from a rocker 10 which can rotate around a second axis 11 and is mechanically connected to said lever. Second axis 11 is substantially parallel to first axis 4 but in other embodiments can be also perpendicular or arranged in another way with respect to first axis 4.

Figure 4:
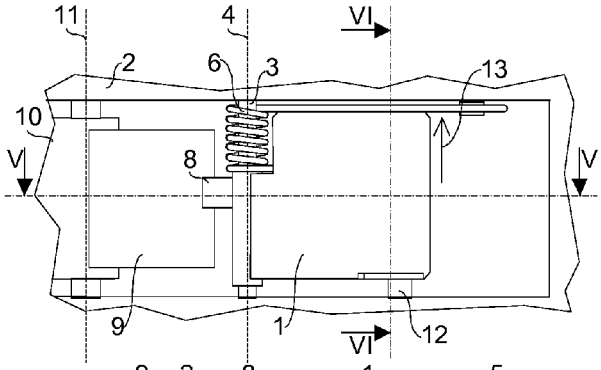
FIG. 4 shows the device of FIG. 1 during an impact.
Figure 5:
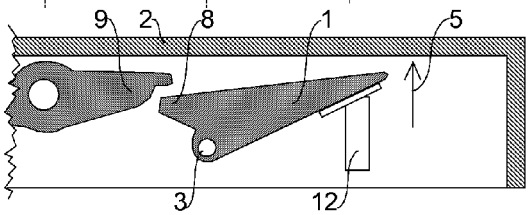
FIG. 5 shows section V-V of FIG. 4.
Figure 6:
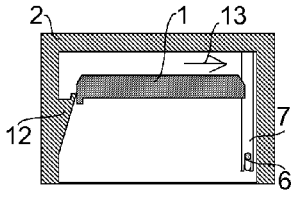
FIG. 6 shows section VI-VI of FIG. 4.

Referring also to FIGS. 4 to 6, it is seen that a wedge 12 is arranged beside inertial mass 1 in frame 2, in particular it is made in a single piece with frame 2, so that inertial mass 1, when it rotates around first axis 4, also slides along the inclined wall of wedge 12, which moves axially inertial mass 1 along first axis 4 in a second direction 13 substantially perpendicular to first direction 5. Elastic means act on inertial mass 1 for opposing the axial movement in second direction 13 of inertial mass 1 when the latter rotates around first axis 4. In particular, said elastic means preferably consists of the same helical spring 6, which is compressed axially when inertial mass 1 moves in second direction 13.

Figure 7:
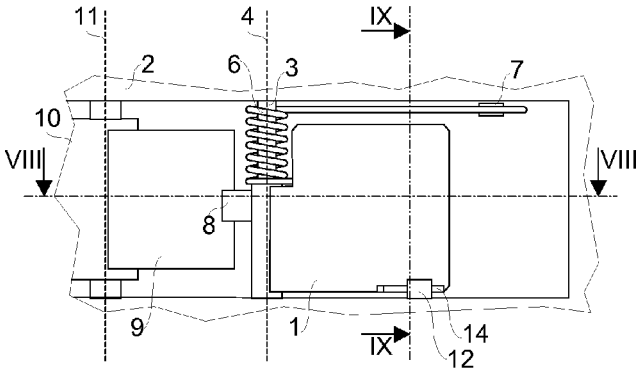
FIG. 7 shows the device of FIG. 1 after an impact.
Figure 8:
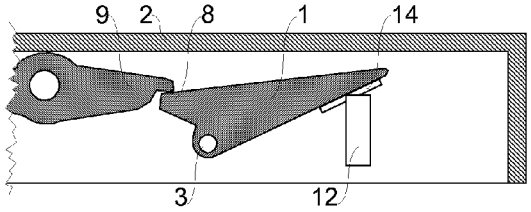
FIG. 8 shows section VIII-VIII of FIG. 7.
Figure 9:
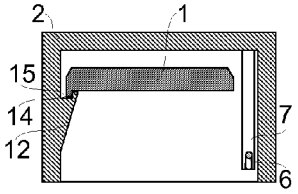
FIG. 9 shows section IX-IX of FIG. 7.

Referring also to FIGS. 7 to 9, it is seen that when inertial mass 1 has gone beyond wedge 12 during the rotation around first axis 4, helical spring 6 can expand, so as to move axially inertial mass 1, which is then locked by the transversal wall of wedge 12 and cannot rotate around first axis 4, even if urged by helical spring 6. For improving this locking also with axial accelerations, inertial mass 1 and/or wedge 12 are provided with a tooth 14 which can penetrate into a seat 15 made in the transversal wall of wedge 12 and/or in inertial mass 1, respectively. In this position, stop member 8 intercept protrusion 9 and prevents the rotation of rocker 10.

For unlocking inertial mass 1, a point, for example of a screwdriver, can be used as a lever between inertial mass 1 and frame 2 close to wedge 12, so that inertial mass 1 goes beyond wedge 12 and is taken back in the rest position by helical spring 6.

Possible modifications and/or additions may be made by those skilled in the art to the hereinabove disclosed and illustrated embodiment while remaining within the scope of the following claims,

The invention claimed is:

1. A vehicle handle of a motor vehicle, comprising:

a frame; and a safety device comprising:

an inertial mass pivoted to the frame for rotating around an axis due to a force induced by an impact of the motor vehicle, wherein elastic means act on the inertial mass for opposing its rotation; and a wedge arranged in the frame so that the inertial mass, when the inertial mass rotates around the axis, slides along an inclined wall of the wedge, so as to axially move the inertial mass along the axis in order to prevent the rotation of a rocker.

2. The vehicle handle according to claim 1, wherein the elastic means act on the inertial mass for opposing said axial moving.

3. The vehicle handle according to claim 1, wherein said elastic means comprise a helical spring arranged around said axis.

4. The vehicle handle according to claim 3, wherein the helical spring has an end in contact with a support of the frame and another end in contact with the inertial mass.

5. The vehicle handle according to claim 1, wherein the wedge is arranged beside the inertial mass.

6. The vehicle handle according to claim 1, wherein the inertial mass, when it has gone beyond the wedge during the rotation around said axis, is locked by the transversal wall of the wedge.

7. The vehicle handle according to claim 1, wherein the inertial mass and/or the wedge are provided with a tooth which can penetrate into a seat made in the wedge and/or in the inertial mass, respectively.

8. The vehicle handle according to claim 7, wherein said seat is made in the transversal wall of the wedge.

9. The vehicle handle according to claim 1, wherein the wedge is made in a single piece with the frame.

* * * * *